US011590430B2

(12) United States Patent
Farewell, Jr.

(10) Patent No.: US 11,590,430 B2
(45) Date of Patent: Feb. 28, 2023

(54) ANALOG DC MODEL TRAIN SYSTEM AND METHOD OF USE

(71) Applicant: Richard C. Farewell, Jr., Golden, CO (US)

(72) Inventor: Richard C. Farewell, Jr., Golden, CO (US)

( * ) Notice: Subject to any disclaimer, the term of this patent is extended or adjusted under 35 U.S.C. 154(b) by 1039 days.

(21) Appl. No.: 16/258,645

(22) Filed: Jan. 27, 2019

(65) Prior Publication Data

US 2019/0232181 A1 Aug. 1, 2019

Related U.S. Application Data

(60) Provisional application No. 62/622,855, filed on Jan. 27, 2018.

(51) Int. Cl.
*A63H 19/24* (2006.01)
*A63H 19/10* (2006.01)
*H05B 45/30* (2020.01)

(52) U.S. Cl.
CPC ..... *A63H 19/24* (2013.01); *A63H 19/10* (2013.01); *H05B 45/30* (2020.01); *A63H 2019/246* (2013.01)

(58) Field of Classification Search
CPC ..... A63H 19/00; A63H 19/02; A63H 19/10; A63H 19/14; A63H 19/16; A63H 19/24; A63H 2019/243; A63H 2019/246; A63H 30/04; H05B 45/00; H05B 45/30
See application file for complete search history.

(56) References Cited

U.S. PATENT DOCUMENTS

| | | | | |
|---|---|---|---|---|
| 6,908,066 | B2 * | 6/2005 | Koenig | A63H 19/24 246/122 A |
| 7,563,150 | B2 * | 7/2009 | Yamaguchi | A63H 17/045 446/454 |
| 7,659,834 | B2 * | 2/2010 | Young | A63H 19/10 105/29.2 |
| 8,001,908 | B2 * | 8/2011 | Webster | A63H 19/16 105/280 |
| 8,154,227 | B1 * | 4/2012 | Young | A63H 30/04 318/268 |
| 9,744,470 | B2 * | 8/2017 | Sato | A63H 19/24 |
| 10,308,265 | B2 * | 6/2019 | Fahmy | B61L 23/044 |
| 10,579,073 | B2 * | 3/2020 | Dembinski | B61L 27/14 |
| 2002/0046675 | A1 * | 4/2002 | Young | A63H 19/24 104/295 |

(Continued)

*Primary Examiner* — Zachary L Kuhfuss
*Assistant Examiner* — Cheng Lin
(74) *Attorney, Agent, or Firm* — Leavitt Eldredge Law Firm

(57) ABSTRACT

A system for use with an analog DC model train, the system includes a base unit to electronically communicate with a track of the analog DC model train, the base unit having a receiver; one or more microcontrollers; a potentiometer; a digital stepper motor connected to the digital stepper motor and to provide torque to turn the potentiometer; a controller to communicate wirelessly with the receiver, the controller having a control to send a command the base unit to set a first numerical value associated with a position of the digital stepper motor; the first numerical value can be retrieved by the base unit based on commands from the controller to set the position of the digital stepper motor.

7 Claims, 4 Drawing Sheets

(56) References Cited

U.S. PATENT DOCUMENTS

| | | | | |
|---|---|---|---|---|
| 2004/0032395 | A1* | 2/2004 | Goldenberg | G06F 3/0362<br>345/156 |
| 2005/0023999 | A1* | 2/2005 | Denen | H02K 21/12<br>318/6 |
| 2005/0054450 | A1* | 3/2005 | Yamaguchi | A63H 30/04<br>463/58 |
| 2007/0001058 | A1* | 1/2007 | Severson | A63H 19/24<br>246/1 R |
| 2013/0005215 | A1* | 1/2013 | Tell | A63H 17/00<br>446/456 |

* cited by examiner

ANALOG DC MODEL TRAIN SYSTEM AND METHOD OF USE

BACKGROUND

1. Field of the Invention

The present invention relates generally to model train systems, and more specifically, to a system for providing remote control of a dc analog model train.

2. Description of Related Art

Direct current (DC) model train systems are well known in the art and are commonly used in model train hobbies and amongst model train collectors. Conventional DC model train systems involve a track connected to a power source and a control, wherein the track receives power from the power source and control.

One of the problems commonly associated with conventional DC model trains is the limited ability to change voltage to the track, particularly from a remote. For example, conventional DC model trains work by receiving power from a simple transformer, the simple transformer having a handle whereby the user can manually change the power output to the track, therefore, the user cannot easily and conveniently change speeds to the track.

Accordingly, although great strides have been made in the area of DC model train systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

and

Figure 1:
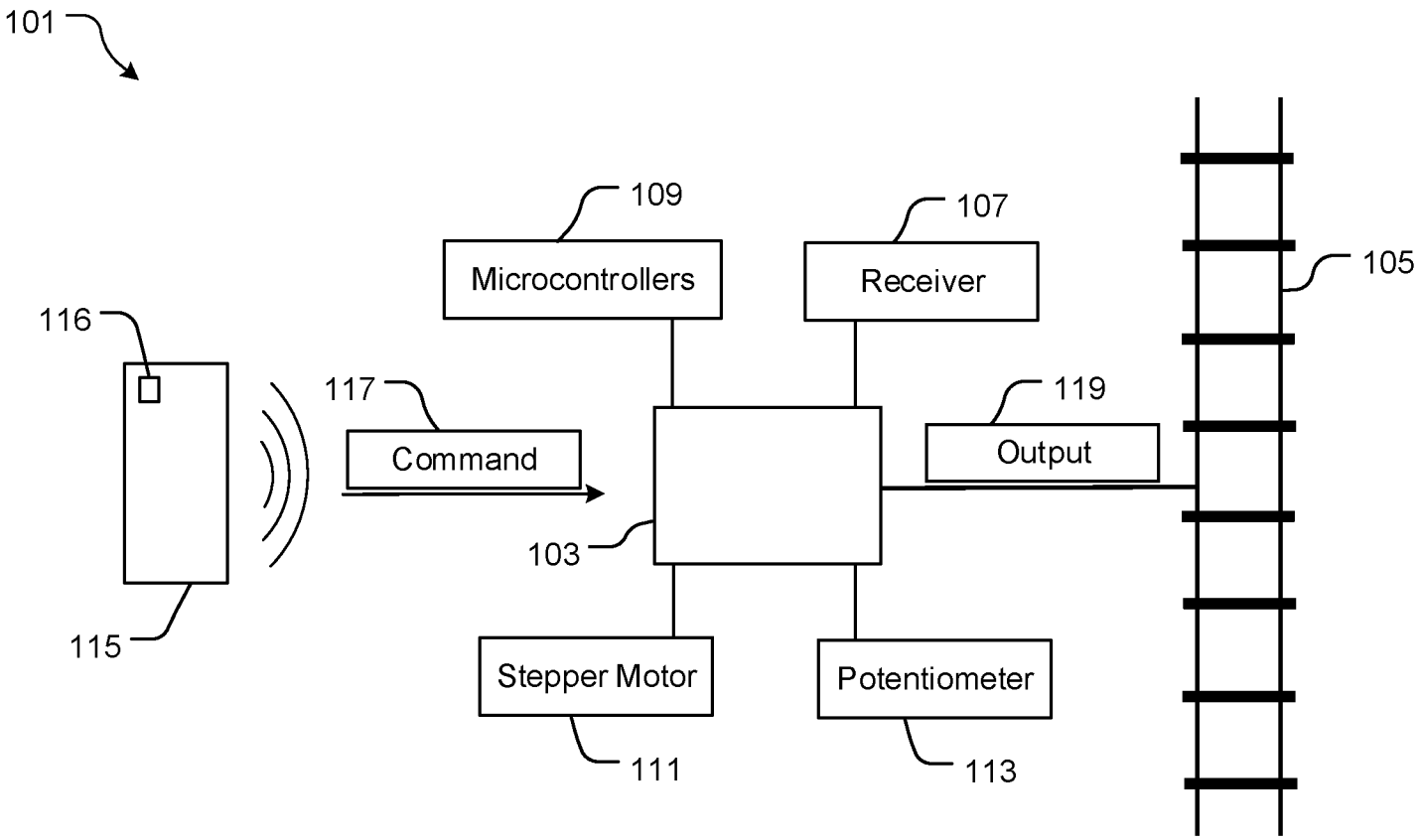
FIG. 1 is a simplified schematic of an analog dc model train system in accordance with a preferred embodiment of the present application.
Figure 4:
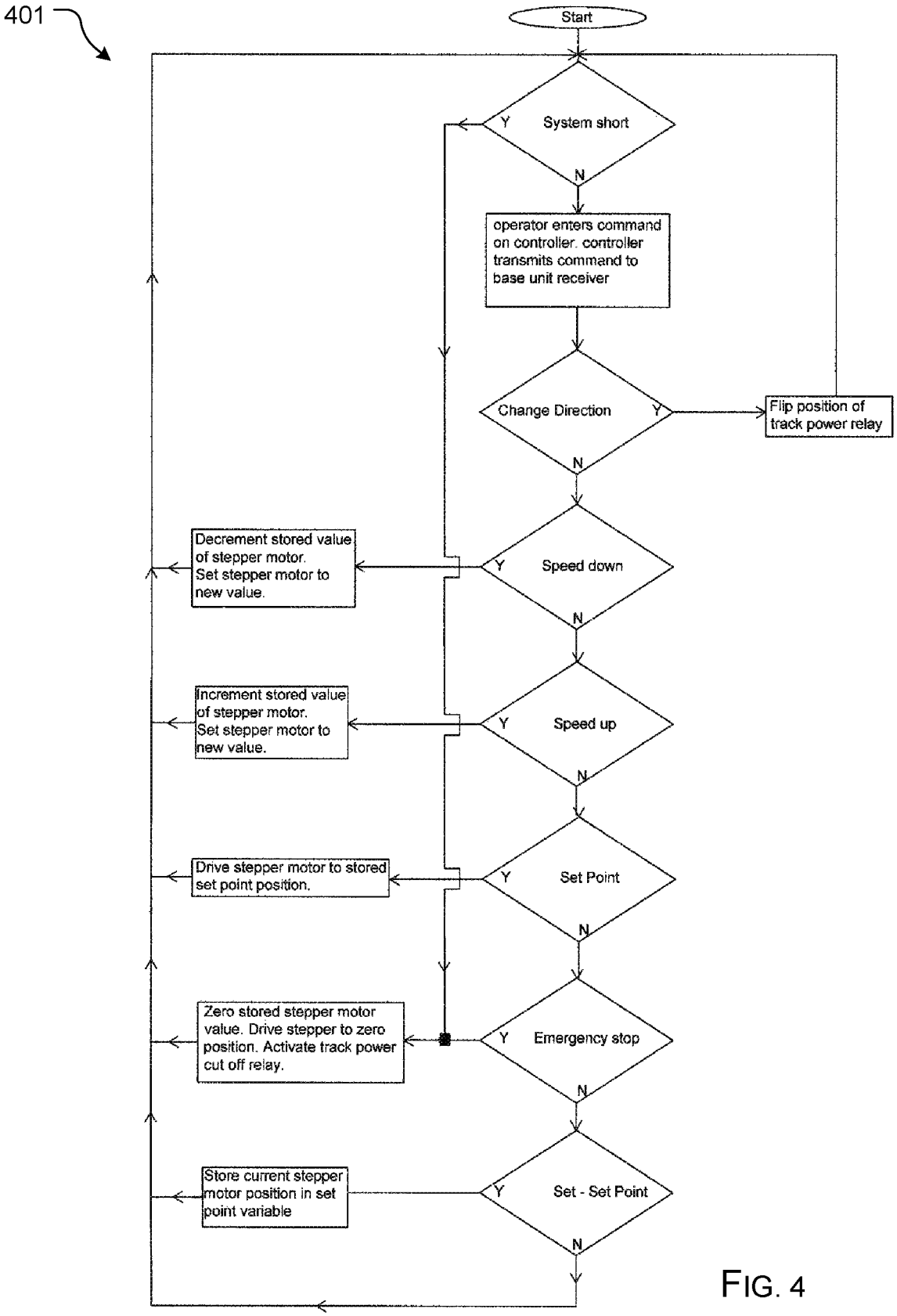

FIG. 4 is a flowchart of the method associated with a microcontroller of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional DC train systems. Specifically, the present invention provides a means to control voltage output to a track based on assigned numerical values for a plurality of positions of a digital stepper motor from a remote. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a simplified schematic of system 101 for use with an analog DC model train in accordance with a preferred embodiment of the present application. It will be appreciated that system 101 overcomes one or more of the above-listed problems commonly associated with conventional DC model train systems.

In the contemplated embodiment, system 101 includes a base unit 103 configured to electronically communicate with a track 105 of an analog DC model train. In the preferred embodiment, the base unit 103 comprises a receiver 107, one or more microcontrollers 109, a digital stepper motor 111, and a potentiometer 113. It should be understood that in the preferred embodiment, the potentiometer 113 is directly connected to the stepper motor 111, thereby using torque produced by the stepper motor 111 to turn the potentiometer 113.

System 101 further includes a controller 115, such as a remote control, a computing device, a mobile phone, or any other device having a transmitter configured to wirelessly communicate with base unit 103. In the preferred embodiment, the wireless communication is achieved via radio waves, however, it should be appreciated that other technology could be used. Controller 115 includes a plurality of buttons, switches, and the like 116, being configured to provide commands 117 to base unit 103.

In one embodiment, the controller 115 includes at least a toggle control, a light emitting diode configured to indicate a current traveling direction of the train model, an emergency stop control, and a speed control. However, it should be appreciated that various other controls and functions could be incorporated into the controller 115.

During use, as is further described in connection with the various flowcharts herein, base unit 103 is configured to provide output 119 to track 105.

It should be appreciated, that in the preferred embodiment, the one or more microcontrollers 109, include a first microcontroller configured to receive a serial signal from the receiver 107 and convert the serial signal into a 3 bit binary number, and a second microcontroller configured to receive the 3 bit binary number from the first microcontroller to process the command from the controller and store a plurality of numerical values associated with a plurality of positions of the digital steppe motor 111.

It should be appreciated that one of the unique features believed characteristic of the present application is the connection of the stepper motor to one or more microcontrollers, wherein the one or more microcontrollers receive commands from a controller to adjust positions of the potentiometer via the stepper motor, thereby altering voltage output to the track. It should be appreciated that the one or more microcontrollers can assign a plurality of numerical values to then be retrieved by the user on demand, the plurality of numerical values correlating to a plurality of positions of the stepper motor. For example, the user can command to store any speed (voltage output) that a train is traveling as a numerical value. When the user desires to return to this speed, the simply command to activate the set numerical value.

Figure 2:
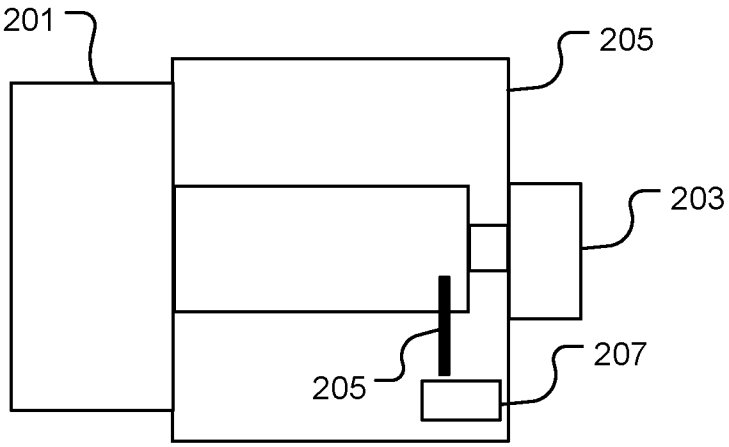
FIG. 2 is a simplified schematic of a digital stepper motor of FIG. 1 and related components.

In FIG. 2, a simplified schematic of a stepper motor 201 and related components is shown for clarity. It should be appreciated that the stepper motor is in communication with the one or more microcontrollers for functionality. The stepper motor 201 is directly connected to the potentiometer 203 and includes a frame structure 205 for support. The stepper motor receives a signal from a peripheral driver to turn the shaft of the potentiometer 203 to adjust resistance to a pin 205 of a regulator. This in turn adjusts track voltage up or down, as is the conventional means of controlling speed in an analog train. For zeroing, a limit switch 207 is actuated by pin 205. Every time the stepper motor is brought to a 0 position, the limit switch 207 is closed, allowing the microcontroller to always have a reference of 0 position of the stepper motor.

Figure 3:
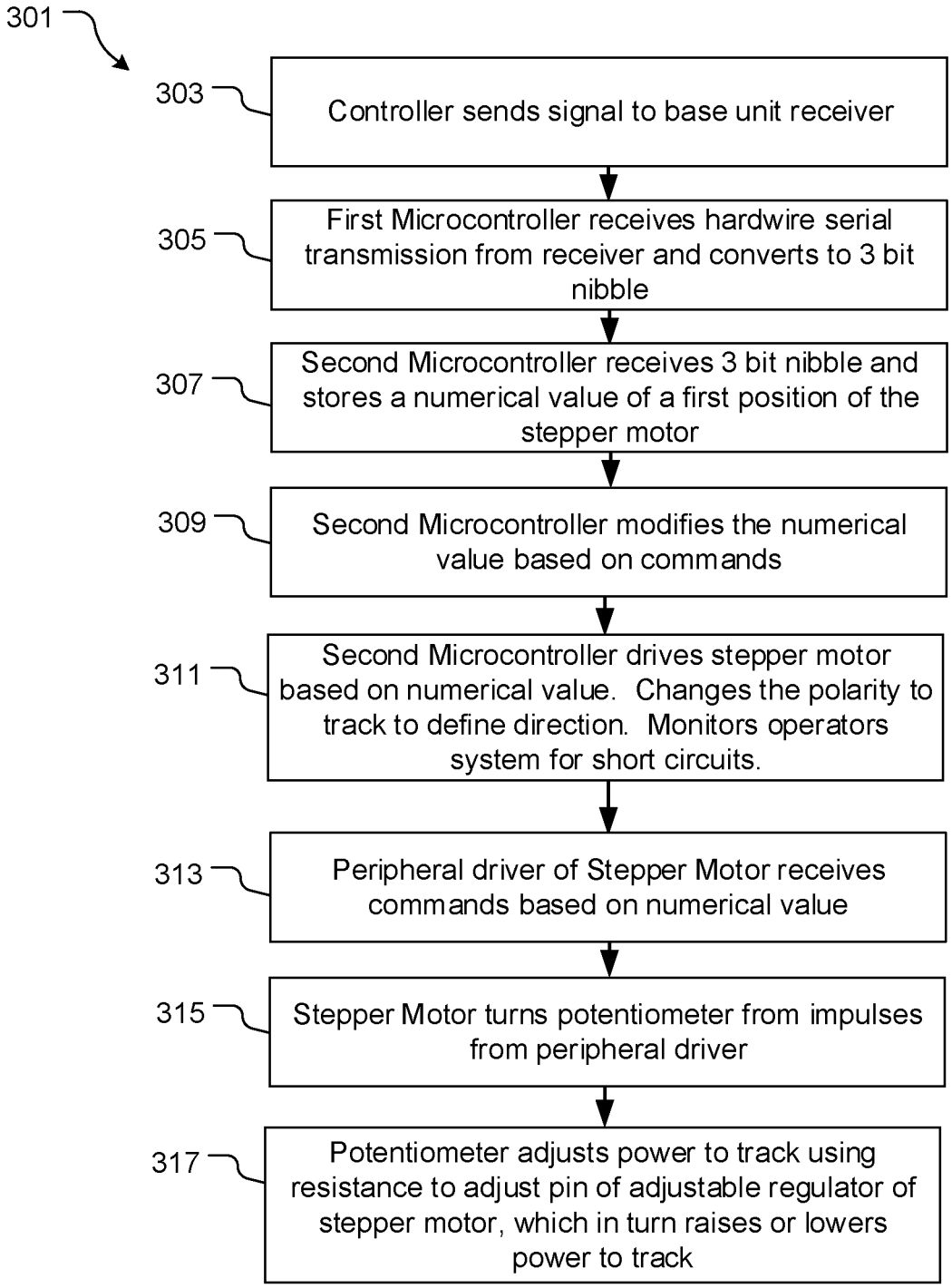
FIG. 3 is a flowchart of the method of circuitry flow inside the base unit of FIG. 1.

In FIG. 3, a flowchart 301 depicts a method of circuitry flow inside the base unit 103. First, a signal is transmitted from the controller and received by the receiver and converted into serial hard wire transmission, as shown with box 303. The first microcontroller receives the hardwire serial transmission from the receiver and converts it to a 3 bit nibble, as shown with box 305. The second microcontroller receives the 3 bit nibble from the first microcontroller and stores a numerical value of a position of the stepper motor, as shown with box 307. The second microcontroller further modifies the numerical value based on commands, thereby creating a plurality of numerical values relating to a plurality of positions of the stepper motor, as shown with box 309. The stepper motor is driven based on commands associated with the plurality of numerical values, as well as commands relating to track direction, as shown with box 311. For further clarity, the peripheral driver receives numerical commands to drive the stepper motor, which further turns the potentiometer, as shown with boxes 313, 315. The potentiometer adjusts power to the track, as shown with box 317.

In FIG. 4, again for clarity, another flowchart 401 depicts the operation of the microcontroller. The operator enters commands on controller, which transmits a signal to the receiver of the base unit. The operator can opt to change directions or first set a speed. After the first speed is set from the controller, the base unit, particularly through use of the one or more microprocessors sets a first value. The operator can then adjust the speed up or down and command to set a second value. The operator can therefore program a plurality of numerical values associated with a plurality of speeds (positions of stepper motor), which are recorded and stored for future use. Each of the plurality of values can then be recalled at a later time to activate the desired speed.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system for use with an analog DC model train, the system comprising:

a base unit configured to electronically communicate with a track of the analog DC model train, the base unit having:

a receiver;

one or more microcontrollers, having:

a first microcontroller configured to receive a serial signal from the receiver and convert the serial signal into a 3 bit binary number; and a second microcontroller configured to receive the 3 bit binary number from the first microcontroller to process the command from the controller and store the first numerical value associated with the position of the digital stepper motor;

wherein the second microcontroller drives the digital stepper motor;

a potentiometer;

a digital stepper motor connected to and configured to provide torque to turn the potentiometer, the digital stepper motor is directly connected to the potentiometer;

a pin associated with the digital stepper motor; and a limit switch controlled by the pin;

a controller configured to communicate wirelessly with the receiver, the controller having:

a control configured to send a command to the base unit to set a first numerical value associated with a position of the digital stepper motor;

wherein the first numerical value can be retrieved by the base unit based on commands from the controller to set the position of the digital stepper motor.

2. The system of claim 1, wherein the controller is a remote.

3. The system of claim 1, wherein the controller further comprises:

a toggle control;

a light emitting diode configured to indicate a current traveling direction of the analog DC train model;

an emergency stop control; and a speed control.

4. The system of claim 1, wherein the control is a set point control configured to set and recall one or more set numerical values associated with a plurality of positions of the digital stepper motor.

5. The system of claim 1, wherein the controller is configured to communicate with the base unit via radio signals.

6. A method of assigning a plurality of numerical values to output levels of voltage on an analog DC model train, the method comprising:

providing the system of claim 1;

connecting the digital stepper motor to the potentiometer;

coupling electrically the base unit with a track of the analog DC model train;

sending a command from the controller to the base unit, the command signaling the base unit to set a first numerical value associated with a position of the potentiometer; and saving the first numerical value to be recalled later by the controller.

7. The method of claim 6, further comprising:

sending a second command from the controller to the base unit, the second command signaling the base unit to set a second numerical value associated with a second position of the potentiometer.

* * * * *